United States Patent [19]

Veneklasen

[11] 3,933,078

[45] Jan. 20, 1976

[54] MUSICAL HORN CONSTRUCTION

[76] Inventor: Mark S. Veneklasen, 12338 Montana Ave., Apt. 11, Los Angeles, Calif. 90049

[22] Filed: Nov. 2, 1973

[21] Appl. No.: 412,334

[52] U.S. Cl. ..... 84/387
[51] Int. Cl.[2] ..... G10D 7/10
[58] Field of Search ..... 84/387–394

[56] References Cited

UNITED STATES PATENTS

| | | | |
|---|---|---|---|
| 59,204 | 10/1866 | Fiske | 84/387 |
| 620,450 | 2/1889 | Heald | 84/394 |
| 1,122,207 | 12/1914 | Kloepfel | 84/387 |
| 1,966,119 | 7/1934 | Greenleaf | 84/392 |
| 2,008,900 | 7/1935 | Dewey | 84/392 |
| 2,575,540 | 11/1951 | Wenger | 84/387 X |
| 2,790,345 | 4/1957 | Greenleaf | 84/388 |
| 3,175,449 | 3/1965 | Kravka | 84/390 |
| 3,504,383 | 4/1970 | Young | 4/191 |

*Primary Examiner*—Lawrence R. Franklin
*Attorney, Agent, or Firm*—William W. Haefliger

[57] ABSTRACT

A horn incorporates improvements in tubing support and sealing, water bleed control, valve stoppers, tone holes, tubing cross section, switch valve construction, finger key supports and connections, flexible valve elements, mouthpiece receiver and lead pipes.

15 Claims, 26 Drawing Figures

201
203
30
31
204
202
200

MUSICAL HORN CONSTRUCTION

BACKGROUND OF THE INVENTION

This invention relates generally to the construction and operation of wind instruments, and more particularly concern solutions to longstanding problems which result from the conventional construction of such instruments.

Among such problems are the difficulty of assembling and disassembling the tubing sections, crooks, bends, and valves of brass instruments; the difficulty of playing reed instruments due to structional discontinuities in the tubing bores; the difficulty of finger actuation of keys of brass instruments due to conventional placement of such keys; and other problems.

SUMMARY OF THE INVENTION

It is a major object of the invention to provide solutions to the above problems, as well as improvements in construction and mode of operation of wind instruments, as will be seen.

Basically, the invention is embodied in a horn having multiple valve modules, and tubes defining straight path sections and crooks, and includes a support frame, and means removably retaining the tubing at multiple locations to the support frame. As will appear, such means may advantageously comprise elastomeric O-rings extending between the frame and tubing at such locations, there being sleeves fitting about the tubing and forming annular recesses receiving the rings so that the tubing is non-rigidly coupled to the frame, and rings may be individually installed during assembly and disassembly. Alternatively, removable wedge structure may be located between the frame members and the tubing.

Another feature of the invention comprises the provision of a tapered valve stopper plugging a side opening in the tubing, the inner end of the stopper extending substantially flush with the tubing bore so that bore continuity is not disrupted. The stopper is usable for water bleed or tone control, and is mounted for movement toward and away from a tapered seat at the side opening, as will appear. Alternatively, as will be seen, tubing of rectilinear section may be used together with conventional tone control openings to greatly reduce bore discontinuity suffered with round sections. A further feature concerns the provision of a switch valve containing dual passages, and movable to alternately and selectively communicate one passage between a mouthpiece receiver pipe and one lead pipe, and another passage between the receiver pipe and the other lead pipe of the instrument as will be seen.

Other objects and advantages include the provision of a valve casing having stub tubing integral therewith, such tubing having telescopic interfit with another portion of the straight tubing of the instrument to facilitate quick assembly and disassembly of the tubing relative to the frame; the provision of adjustable loops or crooks for pitch control having O-ring seals; the provision of tension cord and spring urged rotary valve bodies with provision for their remote actuation by finger keys displaceable along convergent paths, and in a manner approximating the natural stroke of the individual fingers; and the provision of tapered adapters removably received by the instrument lead pipe so as to receive a mouthpiece stem, in the manner to be described.

These and other objects and advantages of the invention, as well as the details of illustrative embodiments will be more fully understood from the following description and drawings, in which:

DRAWING DESCRIPTION

FIG. 1 is a plan view showing brass instrument tubes and valves mounted on a support frame, FIG. 2 is an enlarged section taken on line 2—2 of FIG. 1;

FIGS. 2*a*, 2*b* and 2*c* are enlarged fragmentary sections showing alternate construction details;

Figure 8A:
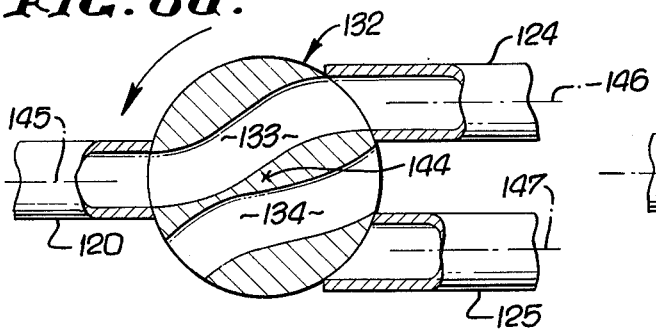
Figure 8B:
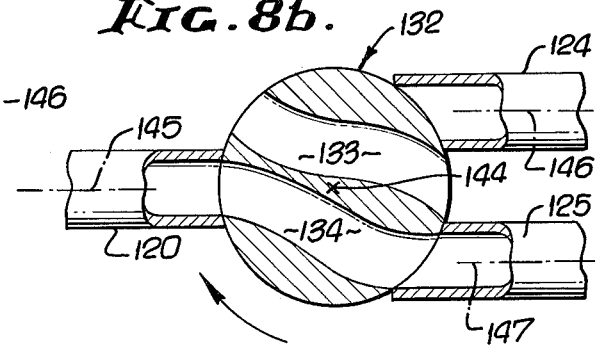
Figure 9A:
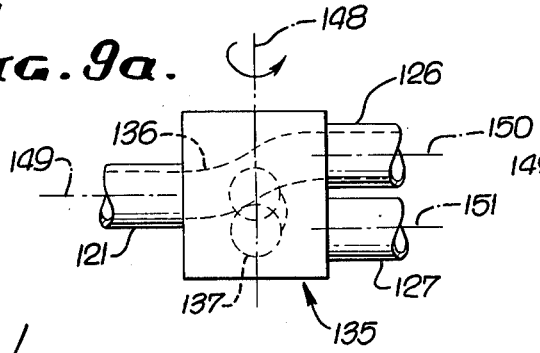
Figure 9B:
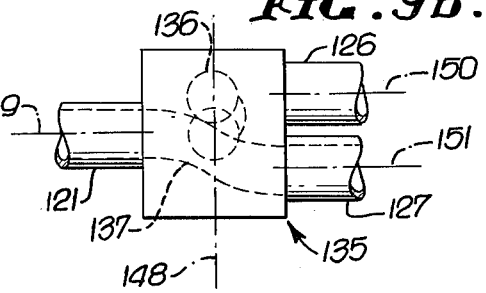
Figure 10A:
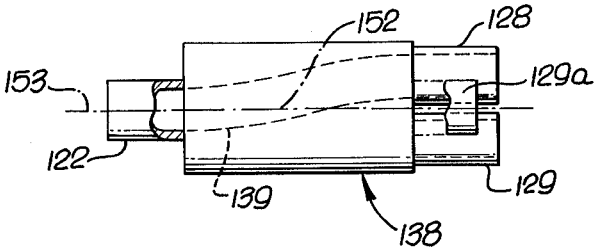
Figure 11A:
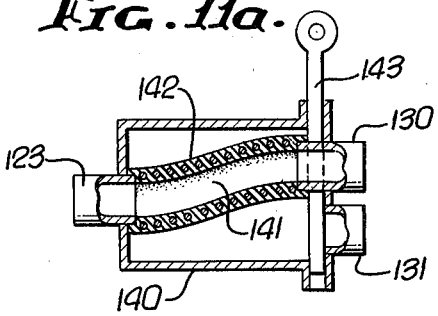
Figure 10B:
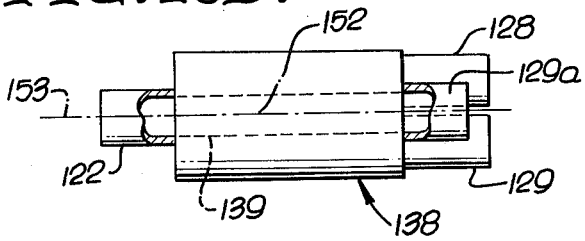
Figure 11B:
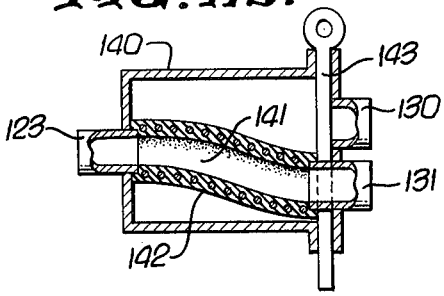
Figure 10C:
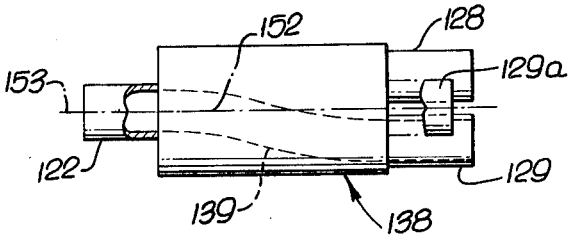
Figure 12:
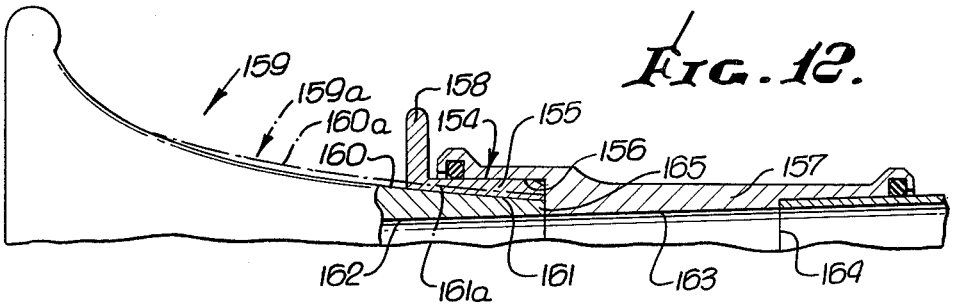
Figure 12A:
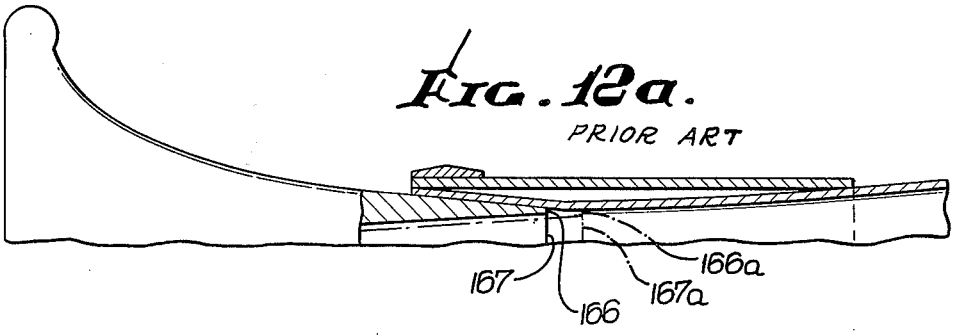
FIG. 12a. PRIOR ART
Figure 13:
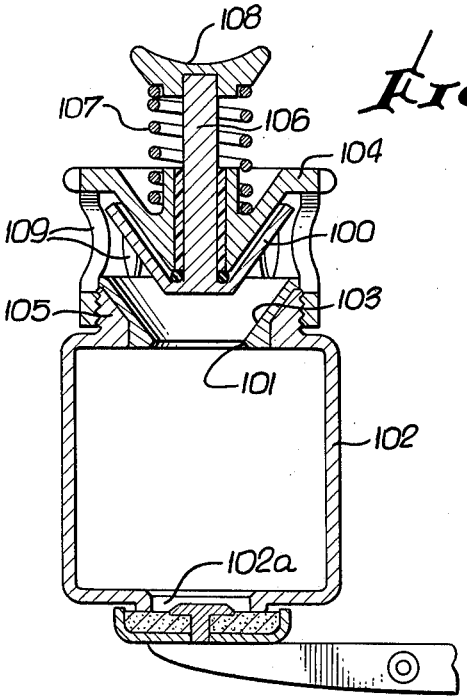
Figure 13A:
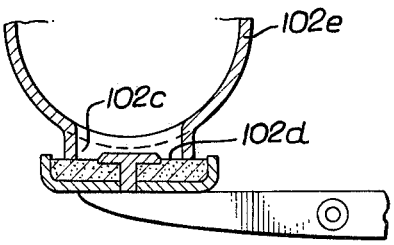
FIG. 13a. PRIOR ART

FIGS. 8*a* and 8*b* are sections through a lead pipe switch valve;

FIGS. 9*a* and 9*b* are sections through a modified lead pipe switch valve;

FIGS. 10*a*, 10*b* and 10*c* are sections through a further modified lead pipe switch valve;

FIGS. 11*a* and 11*b* are sections through a further modified lead pipe switch valve;

FIG. 12 is a section through a mouthpiece adapter connection to a brass instrument lead pipe;

FIG. 12*a* is a view of a conventional mouthpiece and receiver;

FIG. 13 is a section through a tone-hole valve construction;

FIG. 13*a* is a conventional tone-hole detail; and

Figure 14:
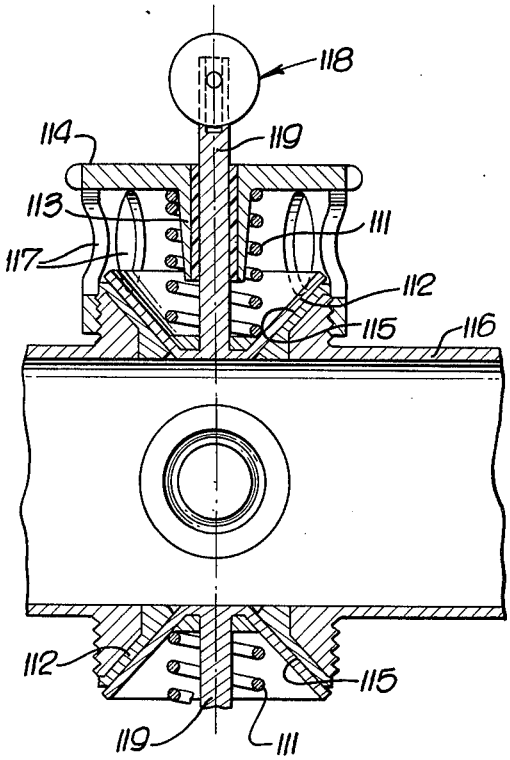
Figure 15:
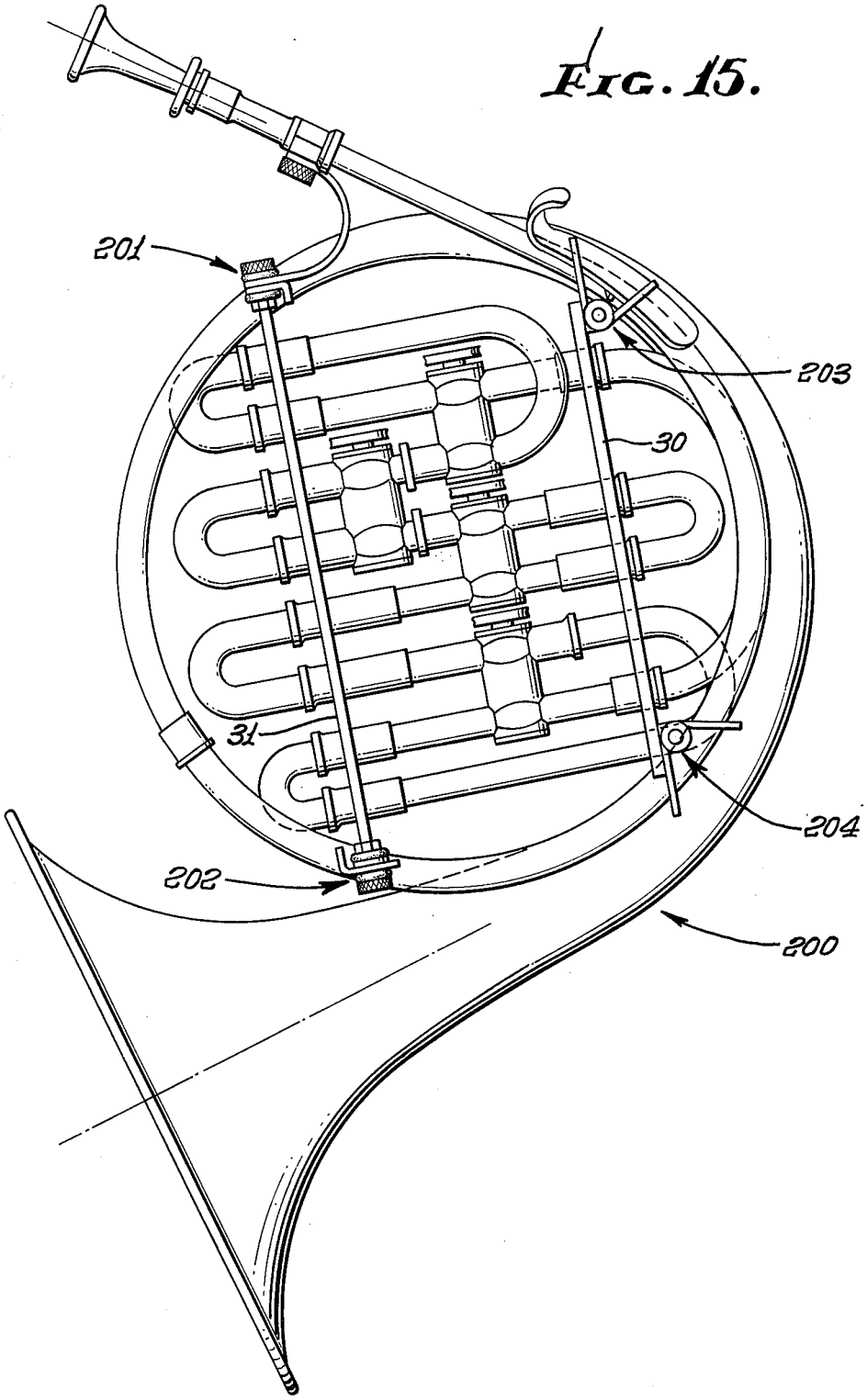

FIG. 14 is a vertical section taken through a modified tone-hole valve construction; and FIG. 15 is an elevation showing application of the invention to a French horn.

DETAILED DESCRIPTION

Figure 1:
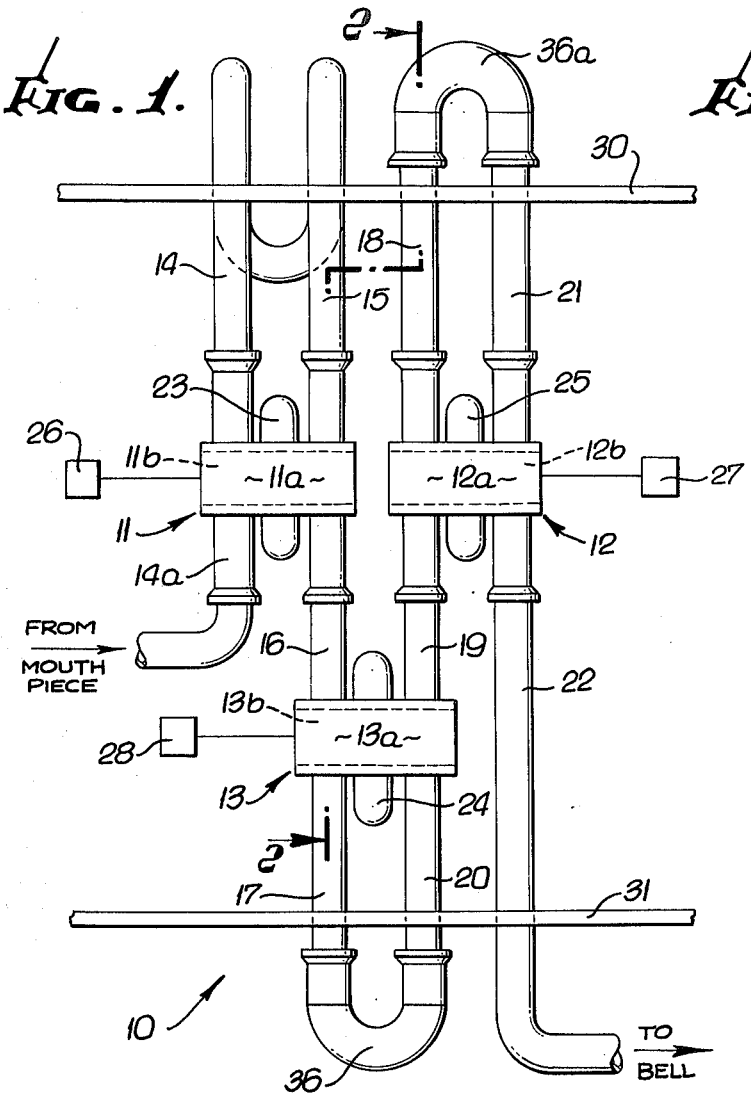

FIG. 1 shows a horn 10 having multiple valve modules 11, 12 and 13, and tubes defining straight path tubing sections 14–22 and tubing loops 23–25. The valve modules may include casings and valve bodies rotatable therein, as by means of finger actuators schematically shown at 26–28. For example, valve 11 may include a casing 11*a* and a cylindrical valve body 11*b* rotatable therein to interconnect section 14*a* with loop 23 and the latter with section 16, in one valve body position, and alternatively to interconnect straight path tubing sections 14 and 14*a* and straight path tubing sections 15 and 16 in the "rotated" body position. See for example the description in my copending application Ser. No. 371,126, filed June 18, 1973. Likewise, in one position body 12*b* interconnects section 19 with loop 25, and the latter with section 22, whereas in rotated position it connects sections 18 and 19, and connects sections 21 and 22; and in one position body 13*b* connects sections 16 with loop 24, and the latter with section 19, whereas in rotated position body 13*b* connects sections 16 and 17 as well as sections 19 and 20.

In accordance with an important aspect of the invention, a support frame is employed, as for example by parallel rigid frame members 30 and 31, and means is provided to removably retain the tubing at multiple locations to the support frame. Extending the description to FIG. 2, elastomeric or rubber O-rings 32 and 33 are provided between an annular portion 30*a* of frame member 30 and a sleeve 33 on the tubing section, there being suitable O-ring grooves on these elements, as shown. This construction occurs at multiple locations where the straight tubing sections approach the frame members, as seen in FIG. 1, and the latter accordingly provides a lattice forming bores to receive the O-rings, one such bore appearing at 35 in FIG. 2. Adjustable tubing crooks as at 36 and 36*a* are located "outside" the space formed between the members 30 and 31. As a result, the tubing sections may be easily disassembled, after removal of these crooks and prying out or otherwise removing the O-rings, then displacing lengthwise the straight tubing sections to free them from the members 30 and 31, the O-rings supporting remaining sections accommodating slight angular displacement of the tubing sections as required to accomplish such disassembly.

Figure 2:
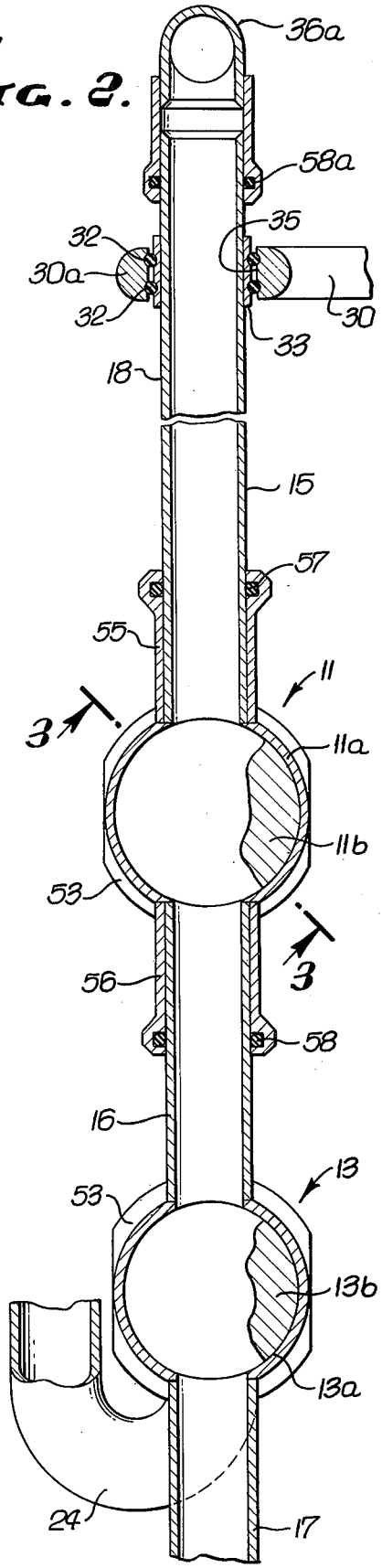
Figure 2A:
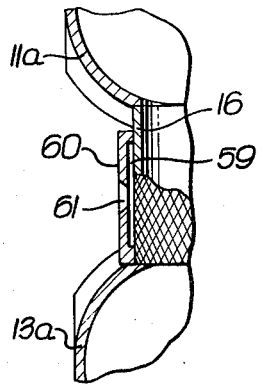
Figure 2B:
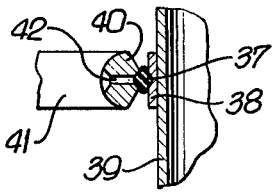
Figure 2C:
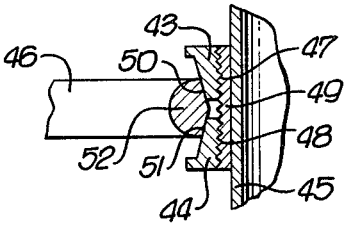
Figure 3:
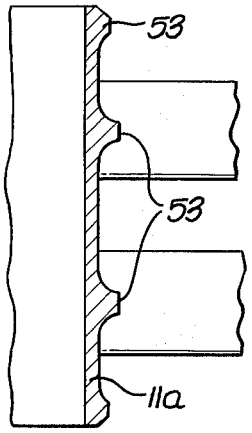
FIG. 3 is a section on lines 3—3 of FIG. 2 showing a modified valve casing.

In the modification seen in FIG. 2*b*, a single O-ring 37 is located between a sleeve 38 on the tubing 39, and an annular portion 40 of the frame member 41. That O-ring consists of an elastomer injected via a hole 42 in portion 40, and cured in situ. In FIG. 2*c*, removable wedge means, as for example wedge rings 43 and 44, is substituted for the O-rings, to removably retain the tubing 45 to the frame 46. Such wedges may have threaded engagement at 47 and 48 with the sleeve 49 on the tubing, and may have wedge surface engagement at 50 and 51 with the annular portion 52 of the frame. As seen in FIGS. 2 and 3, the valve casing 11*a* may include truncated external fins 53 spaced therealong, for stiffening the casing. This acts to provide efficient carry through of bending stresses between the tubing sections, and ensuring casing roundness to prevent binding of the rotary bodies 11*b*–13*b*.

Examination of FIG. 2 will show the provision of stub tubing or tubings, as at 55 and 56, integral with the casing 11*a*. The stub tubing has telescopic interfit with the straight tubing sections 15 and 16 and elastomeric O-rings 57 and 58 engage and seal-off between the stub tubings and the tubing sections as described. This construction also facilitates rapid assembly and disassembly of the horn structure. In the FIG. 2*a* modification, suitable elastomeric O-ring sealant may be injected into a space 59 formed between tubing section 16 and modified stub tube 60, as via access hole 61.

When tubing crooks (as for example 36 and 36*a* in FIG. 1) are provided with elastomeric O-rings in suitable grooves (see 58*a* FIG. 2) and loose telescopic fit, multiple advantages are obtained: leakage associated with the clearance in conventional telescopic slip-joints, which increases with wear, is eliminated; need for grease, which contaminates the instrument and its moving parts, is removed; "creep" of slides or unplanned changes in adjustment are avoided; possibility of "buzz" from loose parts vibrating is reduced by being damped.

Figure 5:
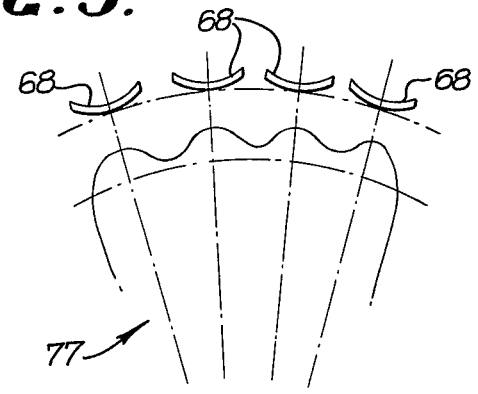
FIG. 5 is a layout of remotely located finger keys.
Figure 4:
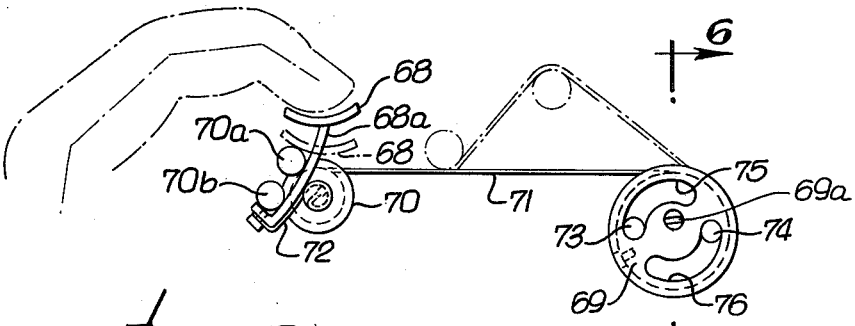
FIG. 4 is a schematic showing of a means for actuating a valve body.
Figure 6:
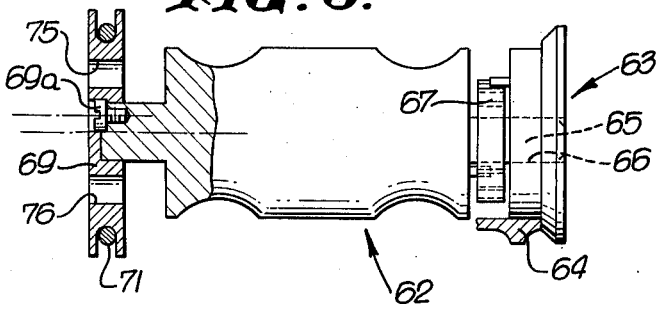
FIG. 6 is a vertical section through a driven pulley as used in FIG. 4.

Referring to FIGS. 4–6, a rotary valve body 62 usable as described above is rotatable relative to a bearing cap 63 suitably carried by the associated casing 64, there being a trunnion 65 on the body 62 projecting into a cap bore 66. Spring means, as for example a torsion spring 67, is connected between the cap and body to urge the body in one rotary direction. In addition, finger actuated means including a remote key (as at 68) is operable to oppose the spring via a tension strand and displace the body 62 in the opposite rotary direction. Such means may include a driven pulley 69 integral with the body, by means such as eccentric screw 69*a*, a drive pulley drive roller 70 proximate the key, a cord or line 71 wound on the driven pulley and drive pulley so that the two rotate together, and a suitable means such as friction or rack type connection or, as shown, a cord 72 between a stem 68*a* on the key and the drive pulley, so that the latter is rotated when the key is depressed. Suitable stop pins 73 and 74 may project into grooves 75 and 76 in the pulley to limit its rotation at locations corresponding to the above described modes of operation of the valve body to connect, or not to connect, the tubing section with the crooks. Such an actuation system, with all forces transmitted in tension between keys and valves, has the dual advantages of low inertia and accommodation of extreme dispersion of valves from the source of control.

Observation of the key assembly shown in FIG. 4, comprised of elements 68, 68*a*, 72, drive pulley-guide roller 70, and guide rollers 70*a* and 70*b*, in relation to the human finger represented therewith, will show that the movement of the key provided conforms closely to the locus of the finger through a natural stroking movement wherein the knuckles are allowed to flex. FIG. 5 shows multiples of such keys for displacing multiples of the valve bodies, as from remote locations. Also, the keys have convergent paths of depressed movement, as indicated by lines 77, to accommodate to natural movement of the player's fingers, as controlled by the separate tendons converging at the wrist for ease of playing the instrument.

Figure 7:
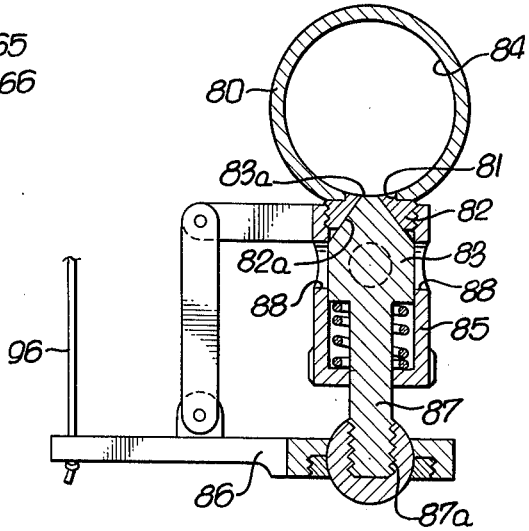
FIG. 7 is a vertical elevation through a modified water valve.
Figure 7A:
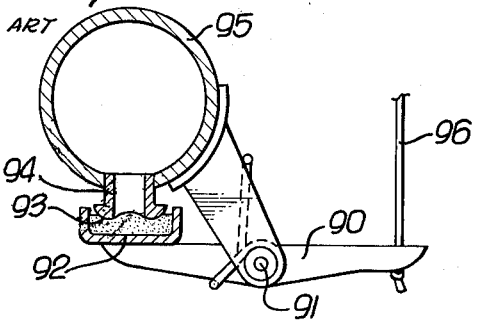
FIG. 7a. PRIOR ART
FIG. 7*a* is an elevation showing a water valve as conventionally employed, for comparison.

Improved "spit" or water drainage control means is embodied in the FIG. 7 showing. The tubing 80 is seen to have a side opening 81 defined by insert 82. A tapered valve stopper 83 engages tapered seat 82*a* to plug the opening, with the inner end 83*a* of the stopper substantially flush with the tubing bore 84. Means is provided to mount the stopper for movement toward and away from that side opening, such means advantageously comprising the insert body 82, and an auxiliary tubular body 85 attached to the insert and containing the stopper. When the stopper is moved away from the side opening, as for example by pivoting of lever 86 to which the stopper stem 87 has universal bearing attachment at 87*a*, a side opening 88 in auxiliary body 85 drains the water expelled from the tubing 80 via the opening 81. Bleed capability is thereby afforded without disruption of the sectional continuity of the tubing, such is not the case in FIG. 7*a*, a showing of a water key as conventionally employed, wherein the tubing sectional volume is augmented by that contained in tubular insert 94. A lever 90 is pivoted at 91 to retract a stopper 92 away from a seat 93 on the extremity of insert 94. Seat 93 is also formed by a tubular insert 94 suitably attached to tubing 95.

In accordance with another aspect of the invention a cord 96 (FIGS. 7 and 7*a*), or other suitable means, may be provided for interconnection with multiples of such bleed valves, or between other type valves employed for this purpose, connecting a conveniently located finger key, providing highly advantageous capability for simultaneous and timely scavenging of water from many locations throughout an instrument.

FIG. 13 illustrates another type of tapered stopper assembly, configured to perform the acoustic function of opening and closing ports, or "tone holes", in the tubing of wind instruments. A stopper 100 is provided for plugging a side opening 101 in tubing 102 when the stopper engages tapered seat 103. Means mounting the stopper for such movement includes an auxiliary body 104 having threaded attachment to a boss 105 on the tubing, a stopper stem 106 projecting upwardly through auxiliary body 104, and a compression spring 107 about the stem and confined between the top of the body 104 and a finger key 108 or cap accommodating other actuating means on the stem. Accordingly, the spring urges the stopper toward retracted position away from seat 103. Body 104 contains multiple tone holes 109 spaced about its circumference providing communication between the tubing interior and the exterior. Bleed control structure at the opposite side of tubing 102 in FIG. 13 and in FIG. 13*a* corresponds to the conventional showing in FIG. 7*a*, and is used here to close tone holes. In a feature of the invention, the rectilinear shape of tubing 102 provides that enlargement of the sectional area imposed at port 102*a* is confined to essentially the area comprised of the tubing thickness. In contrast, FIG. 13*a* illustrates the conventional practice, wherein a large chimney 102*c* is required to accommodate the flat sealing surface at 102*d* in conventional round tubing section 102*e*.

The tone control structure in FIG. 14 is similar to that in FIG. 13, excepting that the compressing spring 111 is there confined between the stopper 112 and a boss 113 on the auxiliary body 114 to urge the stopper against tapered annular seat 115. Communication between the interior of tubing 116 and the exterior via tone holes 117 in the body 114 is then blocked off; however, when remote actuating means, as for example a pivoted arm and roller 118 is operated, the stopper is elevated via its stem 119 for communication via the tone holes. The above construction and that described in FIG. 13 minimizes acoustical disturbance of the air column in the tubing, and provides an expanding acoustical taper from the orifice in the tubing air column to the outside air, in the space formed by the seat and stopper, which condition is thought to be advantageous acoustically.

Another feature of the invention provides that multiple tone holes be introduced in horn tubing on or near the same lateral station along the instrument's longitudinal axis, to be opened or closed either progressively or simultaneously in conjunction with playing the same musical note (See FIG. 14 showing of multiple stopper assemblies for example). The result of this feature acoustically is to make possible extending the maximum breeching of the tubing at one location to 50% and more of the circumference, greatly extending the total acoustic effect obtainable through such tone hole means.

A further feature of the invention concerns the provision of a mouthpiece stub or mouthpiece receiver pipe (as for example at 120, 121, 122 and 123 in FIGS. 8, 9, 10 and 11 respectively); multiple lead pipes (as for example at 124 and 125 in FIG. 8, 126 and 127 in FIG. 9, 128, 129 and 129*a* in FIG. 10 and 130 and 131 in FIG. 11), and a switch valve. The latter designated at 132 in FIG. 8 has first and second passages 133 and 134; the valve 135 in FIG. 9 has first and second passages 136 and 137; the valve 138 in FIG. 10 has single passage 139, and the valve body 140 in FIG. 11 has an integral flexible element 142 with passage 141. In FIGS. 8 and 9 the switch valve is rotatable to alternately communicate the first passage between the receiver pipe and one of the lead pipes (see FIGS. 8*a*, and 9*a*), and the second passage between the receiver pipe and the other of the two lead pipes (see FIGS. 8*b*, and 9*b*). In FIG. 8, the switch valve axis of rotation 144 is perpendicular to the axis 145 of the receiver pipe and to the plane of the lead pipes (i.e. the plane defined by the axes 146 and 147 of pipes 124 and 125); in FIG. 9 the switch valve axis 148 is perpendicular to the lead pipe axis 149, and parallel to the plane defined by the lead pipe axes 150 and 151. In FIG. 10, the switch valve is rotatable to communicate the single passage between the receiver pipe and any one of two or more lead pipes (see FIG. 10*b* for example of communication with third lead pipe 129*a*). The switch valve has one axis of rotation 152 which is co-incident to the axis 153 defined by the receiver pipe. In FIG. 11, the flexible element is moveable to communicate passage 141 between the receiver pipe and one of the two lead pipes (see FIGS. 11*a* and 11*b*). The element is comprised of a helical spring with elastomeric covering, integral with suitable actuating and guiding means, as for example slider 143, as shown. My copending application Ser. No. 371,126 describes the functions of the lead pipe stub or mouthpiece receiver pipe, switch valve and lead pipe elements, in relation to a French horn with multiple sections, as for example one tuned in F baritone, and the other tuned in F alto. In addition to the function referred to above, the valve configurations in FIGS. 8, 9, 10 and 11 may also be applied advantageously to the main body of a wind instrument for the purpose of introducing elongating loops or "crooks" in the fashions also described in this same copending application. The above switch valve constructions provide minimum acoustical deflections from the straight path in all configurations, and when employed in switch valves, enable provision of wholly separate lead pipe tapers for sections of different length, making brass or wind instruments easier to play, with better tone and improved intonation.

Finally, the invention also concerns the provision of means for causing mouthpieces of varying external stem taper and diameter to accurately interface or fit the fixed lead pipe taper of a particular instrument, without producing a "step" in the resultant bore profile or seating at different points longitudinally. A typical conventional configuration is shown in FIG. 12*a* with steps 166 and 166*a*, at different seating positions 167 and 167*a*. FIG. 12 shows such an adapter 154 with a stem 155 received in a straight counterbore 156 in the lead pipe or lead pipe segment 157, there being a button or flange 158 on the adapter for ease of insertion and withdrawal of same. The typical mouthpiece 159 or 159*a* has a tapered stem 160 or 160*a* interfitting the adapter along a tapered seat or bore 161 or 161*a* thereof, there being no resultant step between the bore 162 of the mouthpiece and the bore 163 of the lead pipe. Further, by providing an additional joint 164, creating a lead pipe segment, or second adapter, a step due to variations in thickness of the mouthpiece tip 165 may be eliminated as well.

In FIG. 15 the invention is shown as applied to a French horn 200. The frame members 30 and 31 of FIG. 1 are shown as attached at 201–204 to the horn tubing.

I claim:

1. In a horn in the form of a brass instrument having multiple valves and tubes defining straight path sections and crooks, the combination comprising a. a support frame having elongated metallic members and generally annular portions integral therewith, said portions receiving the tube straight path sections therethrough, b. means removably retaining the tube straight path sections to said frame annular portions, and c. the tube straight path sections having removable telescopic connection with said crooks.

2. The combination of claim 1 wherein said means comprises elastomeric O-rings extending between the frame and tubing at said locations.

3. The combination of claim 2 including members fitting about the tubing at said locations, there being annular recesses between said members and tubing and receiving the O-rings.

4. The combination of claim 3 wherein said means comprises removable wedge structure located between the frame member and the tubing.

5. The combination of claim 1 wherein said support frame includes at least two spaced sections, the tubing extending between and through said sections and including bends at the outer sides of said sections.

6. The combination of claim 1 wherein the valves include valve casings having external ribs.

7. The combination of claim 1 wherein the horn has a valve casing, there being stub tubing integral with the casing and having telescopic interfit with another portion of a first mentioned tube integral with another casing.

8. The combination of claim 7 including elastomeric O-rings engaging the stub tubing and said other portion of the tube and sealing off therebetween.

9. The combination of claim 1 wherein the horn has a valve casing, there being stub tubing integral with the casing and having telescopic interfit with a relatively long tubing section.

10. The combination of claim 1 wherein a valve module comprises a casing and a valve body movable therein, spring means to urge the body in one direction, and finger actuated means including a remote key and tension strand to urge and displace the body in the opposite direction.

11. The combination of claim 10 wherein at least one key is carried for arcuate movement conforming to finger stroking movement.

12. The combination of claim 11 wherein there are multiple of said keys for remotely displacing multiple of said valve bodies, and the keys having convergent paths of actuating movement.

13. The combination of claim 1 wherein the horn has a lead pipe, and adapters removably received into the entrance end of the lead pipe to receive a mouthpiece stem, whereby the inner tapers of mouthpieces of varying external taper, but of the same inner taper, may be caused to register with the lead pipe taper.

14. The combination of claim 13 wherein a second adapter is comprised of an additional lead pipe segment formed to register smoothly the lead pipe taper with that of mouthpieces whose external tapers are the same but whose internal tapers terminate in different diameters.

15. The combination of claim 1 wherein there are at least two of said frame elongated members which are spaced apart and extend in generally parallel relation, the valves located in the space between said members and the crooks located at the opposite sides of said members from said space therebetween.

* * * * *